US006322641B1

(12) United States Patent
Makii et al.

(10) Patent No.: US 6,322,641 B1
(45) Date of Patent: Nov. 27, 2001

(54) HIGH-CARBON STEEL WIRE SUPERIOR IN RESISTANCE TO LONGITUDINAL CRACKING, STEEL PRODUCT FOR THE SAME, AND PROCESS FOR PRODUCTION OF THE SAME

(75) Inventors: Koichi Makii; Nobuhiko Ibaraki; Kenji Ochiai; Atsushi Inada, all of Kobe; Sakae Wada; Takaaki Minamida, both of Kakogawa; Mamoru Nagao, Kobe, all of (JP)

(73) Assignee: Kabushiki Kaisha Kobe Seiko Sho (Kobe Steel Ltd.), Kobe (JP)

( * ) Notice: Subject to any disclaimer, the term of this patent is extended or adjusted under 35 U.S.C. 154(b) by 0 days.

(21) Appl. No.: 09/520,657

(22) Filed: Mar. 7, 2000

(30) Foreign Application Priority Data

Apr. 6, 1999 (JP) ..... 11-098277
Dec. 16, 1999 (JP) ..... 11-356902

(51) Int. Cl.[7] ..... C22C 38/02; C22C 38/04; C21D 8/06; C21D 9/52

(52) U.S. Cl. ..... 148/330; 148/595; 148/598; 148/599

(58) Field of Search ..... 148/320, 598, 148/599, 595

(56) References Cited

U.S. PATENT DOCUMENTS 3,900,347 * 8/1975 Lorenzetti et al. ..... 148/320
5,211,772 5/1993 Ashida et al. .
5,575,866 11/1996 Minamida et al. .
5,873,958 2/1999 Makii et al. .

FOREIGN PATENT DOCUMENTS 40-8283867-A * 10/1996 (JP) .

* cited by examiner

*Primary Examiner*—Deborah Yee
(74) *Attorney, Agent, or Firm*—Oblon, Spivak, McClelland, Maier & Neustadt, P.C.

(57) ABSTRACT

Disclosed herein are a high-carbon steel wire having high strength and superior in resistance to longitudinal cracking, a steel for said high-carbons steel wire, and a process for producing said steel. The high-carbon steel wire is characterized in that the essential components are C (0.65–1.2 wt %), Si (0.1–2.0 wt %), Mn (0.2–2.0 wt %), and Fe, the main phase is pearlite, and the ferrite area ratio is less than 0.40 % in the surface layer up to a depth of 50 $\mu$m from the surface. The high-carbon steel may further contain B (0.0003–0.0050 wt %), Ti (less than 0.030 wt %), and N (less than 0.0050 wt %), with the amount of B, Ti, and N satisfying the following equation $$0.03 \leq B/(Ti/3.43-N) \leq 5.0$$

The resulting steel wire produced in the usual way contains ferrite in an amount less than 0.40 wt % in its surface layer. This low ferrite content is responsible for good resistance to longitudinal cracking because ferrite causes longitudinal cracking to start from it.

8 Claims, 2 Drawing Sheets

AREA IN WHICH MEASUREMENTS ARE CARRIED OUT (IN $\mu$m)

(A) STEEL NOT INCORPORATED WITH BORON

| FERRITE AREA (%) | |
|---|---|
| SURFACE LAYER (S) | CENTRAL PART (C) |
| 0.45 | 0.30 |

(B) STEEL INCORPORATED WITH BORON

| FERRITE AREA (%) | |
|---|---|
| SURFACE LAYER (S) | CENTRAL PART (C) |
| 0.14 | 0.22 |

(A) STEEL NOT INCORPORATED WITH BORON

| FERRITE AREA (%) | |
|---|---|
| SURFACE LAYER (S) | CENTRAL PART (C) |
| 0.45 | 0.30 |

(B) STEEL INCORPORATED WITH BORON

| FERRITE AREA (%) | |
|---|---|
| SURFACE LAYER (S) | CENTRAL PART (C) |
| 0.14 | 0.22 |

AREA IN WHICH MEASUREMENTS ARE CARRIED OUT (IN μm)

HIGH-CARBON STEEL WIRE SUPERIOR IN RESISTANCE TO LONGITUDINAL CRACKING, STEEL PRODUCT FOR THE SAME, AND PROCESS FOR PRODUCTION OF THE SAME

BACKGROUND OF THE INVENTION

1. Field of the Invention

The present invention relates to a carbon steel wire for steel wire cords, wire ropes, etc., a steel product as a raw material for said steel wire, and a process for producing them. This carbon steel wire is finished without heat treatment (such as bluing) after cold rolling.

2. Description of the Related Art

Automotive steel radial tires are reinforced with steel wires such as cord wires and bead wires. Their constituent is a strand composed of twisted high-carbon steel wires, each measuring 0.2 mm in diameter and having a strength greater than 310 kgf/mm$^2$.

Each wire constituting the strand is produced by wire drawing from a eutectoid or hyper-eutectoid high-carbon steel. The step of wire drawing is followed by patenting, pickling, brass plating (to ensure good adhesion to rubber). Final drawing gives a thin wire about 0.2 mm in diameter. The patenting treatment transforms the austenitic structure into the fine pearlite structure at about 500–550° C., thereby making the steel tougher. Automotive tires recently call for improved durability and said steel wires also call for higher strength than before. An effective way to increase strength is to increase the carbon content. However, a mere increase in carbon content results in longitudinal cracking when the wire is twisted. Longitudinal cracking can be effectively prevented by incorporation with chromium. Japanese Patent Laid-open No. 194147/1990 discloses incorporation with 0.10–0.30% of chromium. Japanese Patent Laid-open No. 049592/1994 discloses incorporation with chromium in a specific amount determined by the boron content. The latter is intended to promote the growth of cementite in pearlite and to improve ductility and fatigue characteristics.

OBJECT AND SUMMARY OF THE INVENTION

The above-mentioned first technology (incorporation with chromium) are limited in increase in tensile strength (360 kgf/mm $^2$ at most) and in twist value (25 at most). It is desirable not to add chromium if energy for chromium refinement and recycling of steel products are taken into consideration. The above-mentioned second technology has the disadvantage of requiring chromium as an essential component and being limited in the limiting working ratio of wire drawing (not exceeding the conventional level of 3.6). It does not provide fine steel wires having ultra high strength in excess of 4000 MPa.

The present invention was completed to address the above-mentioned problem. It is an object of the present invention to provide a high-carbon steel wire which exhibits higher strength than before and good resistance to longitudinal cracking even though it is not incorporated with chromium. It is another object of the present invention to provide a steel product for said steel wire. It is further another object of the present invention to provide a process for producing said steel wire and steel product. The invention to achieve these objects is defined in the following.

The first aspect of the present invention resides in a high-carbon steel wire superior in resistance to longitudinal cracking which is characterized in that the essential components are C (0.65–1.2 wt %), Si (0.1–2.0wt %), Mn (0.2–2.0 wt %), and Fe, the main phase is pearlite, and the ferrite area ratio is less than 0.40% in the surface layer up to a depth of 50 $\mu$m from the surface. The expression "the main phase is pearlite" means that the pearlite area ratio is more than 80%. The preferable pearlite area ratio is more than 90%.

The second aspect of the present invention resides in a high-carbon steel wire superior in resistance to longitudinal cracking which is characterized in that the essential components are C (0.65–1.2 wt %), Si (0.1–2.0 wt %), Mn (0.2–2.0 wt %), B (0.0003–0.0050 wt %), Ti (less than 0.030 wt %), N (less than 0.0050 wt %), and Fe, with the amounts of B, Ti, and N satisfying the equation (1), $$0.03 \leqq B/(Ti/3.43-N) \leqq 5.0 \quad (1)$$

the main phase is pearlite, and the ferrite area ratio is less than 0.40% in the surface layer up to a depth of 50 $\mu$m from the surface.

The third aspect of the present invention resides in a steel for a high-carbon steel wire which has the same chemical composition as defined above in the second aspect and which is characterized in that the maximum particle diameter of TiN inclusion is smaller than 8.0 $\mu$m. This steel is processed into the above-mentioned high-carbon steel wire by diameter reduction (including working after patenting) and ensuing patenting.

The fourth aspect of the present invention resides in a process for producing a steel for a high-carbon steel wire, said process comprising casting a steel having the same chemical composition as defined above in the second aspect, cooling the cast at a rate greater than 5° C./sec in the period from the start of casting to the completion of solidification, and hot-rolling go the resulting billet.

The fifth aspect of the present invention resides in a high-carbon steel wire which is characterized in that the essential components are C (0.65–1.2 wt %), Si (0.1–2.0 wt %), Mn (0.2–2.0 wt %), B (0.0003–0.0050 wt %, B in solid solution accounting for more than 0.0003 wt %), N (less than 0.0050 wt %), and Fe, the content of Ti is limited to 0–0.005 wt %, the main phase is pearlite, and the ferrite area ratio is less than 0.40% in the surface layer up to a depth of 50 $\mu$m from the surface. What is unique to this aspect is that the content of Ti in the second aspect is limited.

The sixth aspect of the present invention resides in a steel for a high-carbon steel wire superior in resistance to longitudinal cracking, said steel having the same chemical composition as defined in the fifth aspect. This steel is processed into the high-carbon steel wire (defined in the fifth aspect) by diameter reduction (including working after patenting) and ensuing patenting.

The seventh aspect of the present invention resides in a process for producing a wire rod for a high-carbon steel wire, said process comprising casting a steel whose essential components are C (0.65–1.2 wt %), Si (0.1–2.0 wt %), Mn (0.2–2.0 wt %), B (0.0003–0.0050 wt %), N (less than 0.0050 wt %), and Fe, with the content of Ti being limited to 0–0.005 wt %, cooling the cast at a rate greater than 5° C./sec in the period from the start of casting to the completion of solidification, thereby forming a billet, heating the resulting billet and hot-rolling it such that the finishing temperature is 900–1100° C., and cooling the hot-rolled product to 850° C. within 30 seconds. This process gives the steel for high-carbon steel wire which is defined above in the sixth aspect.

1 also shows the result of measurements of the ferrite area ratio in the surface layer (S) and the core (C) of the high-carbon steel wire made of boron-free steel (A) and boron-containing steel (B).

Figure 2:
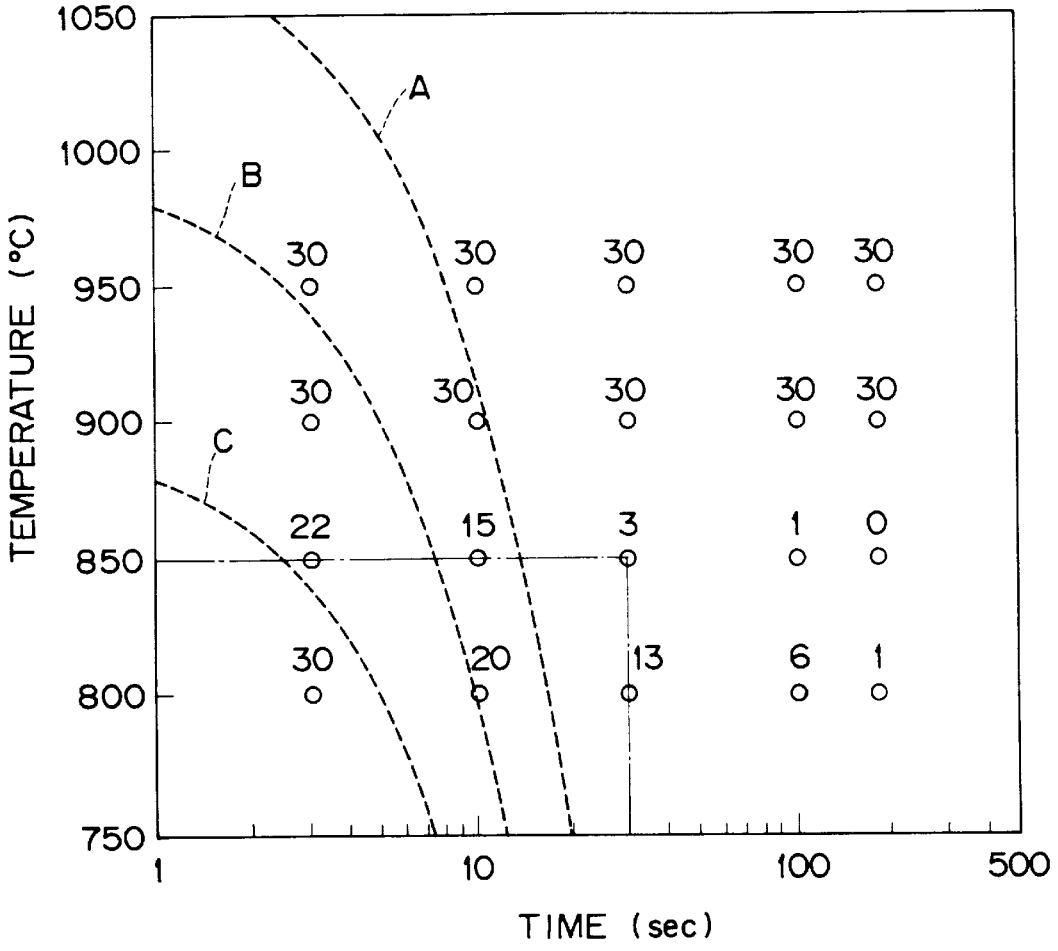

FIG. 2 is a graph showing how the heating temperature and the holding time affect the amount of boron in solid solution in the titanium-free boron-containing hyper-eutectic steel (after holding and quenching). The amount of boron is plotted with the value in ppm.

DESCRIPTION OF THE PREFERRED EMBODIMENTS

The present inventors carried out extensive studies on the reason why longitudinal cracking takes place as a high-carbon steel wire increases in strength. It was found that pro-eutectoid ferrite occurs in the surface layer of the steel wire which has suffered longitudinal cracking even though the steel contains carbon in an amount corresponding to the hyper-eutectoid composition. This pro-eutectoid ferrite seems to be the starting point of longitudinal cracking. As FIG. 1(A) shows, the content of ferrite (in terms of ferrite area ratio) in the surface layer (S) (up to a depth of 50 $\mu$m) is much greater than that in the core (C) in the case of a high-carbon steel wire (0.2 mm in diameter) containing no boron (with an average carbon content of 0.90 wt %). (This steel wire is that designated as Sample No. 20 in Example mentioned later.) Upon investigation into the cause of ferrite formation, it was found that the carbon concentration is extremely low in the surface layer of the steel wire. It seems that the decrease in carbon concentration in the surface layer is due to decarbonization in the course of drawing and heat treatment. This finding has led to an idea that it would be possible to increase strength and improve resistance to longitudinal cracking without adding chromium if the decrease in carbon content in the surface layer is prevented and the formation of ferrite that induces longitudinal cracking in the surface layer is avoided. The present invention was completed on the basis of this idea. The invention will be described in more detail with reference to the embodiments that follow.

The first embodiment pertains to a high-carbon steel wire which is characterized in that the essential components are C (0.65–1.2 wt %), Si (0.1–2.0 wt %), Mn (0.2–2.0 wt %), and Fe, the main phase is pearlite, and the ferrite area ratio is less than 0.40% in the surface layer up to a depth of 50 $\mu$m from the surface.

This high-carbon steel wire has its components limited by the reasons given below.

C: 0.65–1.2 wt %

Carbon is an inexpensive element to increase strength effectively. The larger the amount of carbon, the greater the extent of work hardening due to drawing and the strength after drawing. The smaller the amount of carbon, the more difficult it is to reduce the amount of ferrite. Therefore, according to the present invention, the lower limit of carbon content should be 0.65 wt %, preferably 0.7 wt %, and more preferably 0.8 wt %. On the other hand, with an excess carbon content, the steel wire is liable to breakage during drawing due to net-like pro-eutectoid cementite that is formed in the grain boundary of austenite. This cementite has an adverse effect on toughness and ductility after final drawing into fine wires. The upper limit of carbon content should be 1.2 wt %, preferably 1.1 wt %.

Si: 0.1–2.0 wt % Silicon is an element useful as a deoxidizer. It plays an important role in the present invention which basically covers aluminum-free steel wires. With a content less than 0.1 wt %, silicon does not perform its deoxidizing function. Therefore, the upper limit of silicon content should be 0.1 wt %. On the other hand, with an excess amount, silicon makes it difficult to carry out drawing by mechanical descaling (MD for short hereinafter). Thus, the upper limit of silicon content should be 2.0 wt %, preferably 1.0 wt %, more preferably 0.5 wt %.

Mn: 0.2–2.0 wt %

Manganese is also an element useful as a deoxidizer like silicon. The aluminum-free steel wire according to the present invention needs manganese as well as silicon for effective deoxidizing. Manganese also functions to increase the steel's toughness and ductility as it combines with sulfur in steel to form stable MnS. In addition, it effectively improves hardenability, thereby reducing pro-eutectoid ferrite in the rolled material. For these effects to be produced, the lower limit of manganese content should be 0.2 wt %, preferably 0.3 wt %. On the other hand, manganese is an element prone to segregation. Therefore, manganese in an excess amount forms super-cooled structures such as martensite and bainite in the part where manganese has segregated. They have an adverse effect on drawability. Consequently, the upper limit of manganese content should be 2.0 wt %, preferably 1.0 wt %.

The high-carbon steel wire according to this embodiment is composed of the above-mentioned essential components, with the remainder being inevitable impurities. For improvement in characteristic properties, it may be incorporated with optional elements in an amount not harmful to the functions of the essential components. Examples of such elements will be explained later.

The high-carbon steel wire has the structure as explained in the following. It has the pearlite structure as the main phase which is formed by patenting treatment. This structure is basically similar to the conventional one but is characterized in that the ferrite area ratio is less than 0.40% in the surface layer up to a depth of 50 $\mu$m from the surface of the steel wire.

Longitudinal cracking starts in the surface layer up to a depth of 50 $\mu$m from the surface of the steel wire. Therefore, good resistance to longitudinal cracking develops if the formation of ferrite in this part is suppressed such that the ferrite area ratio is less than 0.40%. This is demonstrated in Examples that follow.

One way to inhibit the formation of ferrite in the surface layer is by incorporation of a steel with a component which inhibits the formation of ferrite (as shown in the second embodiment which follows) or by carburization during or after drawing which precedes patenting. The steel wire of the present invention may be produced basically in the same way as before. Its production process consists of hot rolling, drawing, pickling, patenting, and optional final drawing (wet drawing).

The high-carbon steel according to the second embodiment will be explained in the following. It differs from the one according to the first embodiment in that it contains boron etc. as essential components to prohibit the formation of ferrite. An adequate amount (0.0020 wt %) of boron remarkably inhibits the formation of ferrite in the surface layer (S) of the steel wire as FIG. 1(B) shows in terms of the ferrite ($\alpha$) area ratio in the surface layer (S) and the core (C). This steel wire (containing 0.90 wt % of carbon on average and having a diameter of 0.02 mm) is that designated as Sample No. 11 in Example mentioned later.) This finding is the basis of the high-carbon steel wire according to the second embodiment.

The second embodiment pertains to a high-carbon steel wire which is characterized in that the essential components are C (0.65–1.2 wt %), Si (0.1–2.0 wt %), Mn (0.2–2.0 wt %), B (0.0003–0.0050 wt %), Ti (less than 0.030 wt %), N (less than 0.0050 wt %), and Fe, with the amounts of B, Ti, and N satisfying the equation (1), $$0.03 \leqq B/(Ti/3.43-N) \leqq 5.0 \quad (1)$$

the main phase is pearlite, and the ferrite area ratio is less than 0.40% in the surface layer up to a depth of 50 μm from the surface.

This high-carbon steel wire has its three major components (C, Si, and Mn) limited by the same reasons as mentioned above. It has its other components (B, Ti, and N) limited by the reasons which are explained in detail below.

B: 0.0003–0.0050 wt %

Boron is an important element to be added to inhibit the formation of ferrite in the surface layer up to a depth of 50 μm from the surface. It is generally considered that boron in hypoeutectic steel segregates in the austenite grain boundary, thereby reducing the intergranular energy and decreasing the rate of ferrite formation, and thus producing the effect of inhibiting the formation of ferrite, but boron does not produce its effect in eutectic steel or hyper-eutectic steel. However, in the present invention, the carbon content seems to decrease in the surface layer due to decarbonization during heat treatment. Therefore, boron inhibits the formation of ferrite and effectively prevents longitudinal cracking regardless of whether the average composition is eutectic or hyper-eutectic. In this case, boron is present in the form of free boron. In other words, it exists in steel not as a compound but as an atom in solid solution. With an amount less than 0.0003 wt %, boron does not produce its effect of inhibiting the formation of ferrite and preventing longitudinal cracking. With an amount more than 0.0050 wt %, boron forms a compound such as $Fe_{23}(CB)_6$, decreasing in the amount of free boron, and hence boron does not fully produce its effect of preventing longitudinal cracking. Coarse $Fe_{23}(CB)_6$ grains often cause breakage during drawing. The lower limit of boron content should be 0.0003 wt %, preferably 0.0006 wt %, and the upper limit of boron content should be 0.0050 wt %, preferably 0.0040 wt %.

Ti: less than 0.030 wt %

Titanium combines with nitrogen (which is present inevitably) to form stable TiN, thereby preventing boron from combining with nitrogen and allowing the presence of free boron. However, titanium in an excess amount causes the precipitation of TiC and lamellar ferrite, thereby adversely affecting drawability. In addition, excess titanium gives rise to coarse TiN. Therefore, the amount of titanium should be less than 0.030 wt %, preferably less than 0.015 wt %. The lower limit of titanium content is determined by the equation (1) according to the amount of boron and nitrogen.

N: less than 0.0050 wt %

In this embodiment, nitrogen is fixed by titanium so as to ensure free boron. The content of nitrogen should be as small as possible so that the amount of titanium to be added is reduced. However, reducing the amount of nitrogen excessively raises the production cost of steel. Thus, the upper limit of nitrogen content should be 0.0050 wt %, preferably 0.0035 wt %, and more preferably 0.0020 wt %.

$$0.03 \leqq B/(Ti/3.43-N) \leqq 5.0 \quad \text{Equation (1)}$$

The term (Ti/3.43–N) in this equation represents the amount of excess titanium in the case where all nitrogen is fixed by titanium. If the value of this term is less than 0.03, it means that the amount of excess titanium is too large relative to the amount of boron added. Therefore, excess titanium forms TiC and coarse TiN, both of which adversely affect drawability. If the value of the term is greater than 5.0, it means that the amount of excess titanium is too small relative to the amount of boron added. The result is that the amount of free boron is too small and the formation of ferrite is not inhibited as desired. Therefore, the lower limit of the value of the term should be 0.03, preferably 0.50, and the upper limit of the value of the term should be 5.0, preferably 4.0, and more preferably 2.5.

The high-carbon steel wire according to the second embodiment is composed of the above-mentioned essential components, with the remainder being inevitable impurities. For improvement in characteristic properties, it may be incorporated with optional elements in an amount not harmful to the functions of the essential components, as in the first embodiment. Examples of such elements are Cr (less than 0.8 wt %), Cu (less than 0.5 wt %), Ni (less than 0.5 wt %), Nb (less than 0.02 wt %), and V (less than 0.02 wt %). Any one or more of these elements may be added to the basic components specified in the first or second aspect of the present invention. The resulting composition will be any one of the following compositions, with the remainder being iron.

(1) Basic components+Cr
(2) Basic components or composition (1)+Cu
(3) Basic components or composition (1) or (2)+Ni
(4) Basic components or composition (1), (2), or (3)+ either or both of Nb and V.

Cr: less than 0.8 wt %

Chromium makes fine the lamellar intervals of pearlite and improves the strength and drawability of the wire rod. For chromium to produce its effects, the amount of chromium should be more than 0.05 wt %, preferably 0.1 wt %. On the other hand, chromium in an excess amount tends to form undissolved cementite and prolongs time required for transformation to complete. Moreover, it gives rise to supercooled structure (such as martensite and bainite) in the hot-rolled wire rod, and it has an adverse effect on mechanical drawability. Therefore, the upper limit of chromium content should be 0.8 wt %.

Cu: less than 0.5 wt %

Copper improves the corrosion resistance of extremely fine steel wires. It also improves descalability at the time of mechanical drawing and prevents die seizure. For copper to produce its effects, the amount of copper should be larger than 0.05 wt %. On the other hand, copper in an excess amount causes blistering on the wire surface even though the hot-rolled wire rod is kept at a high temperature of about 900° C. Under the blister in steel occurs magnetite, which has an adverse effect on mechanical drawability. Moreover, copper reacts with sulfur to form CuS which segregates in the grain boundary, causing flaws in the billet and wire rod in the course of wire rod production. Such adverse effects should be avoided by limiting the maximum copper content to 0.5 wt %.

Ni: less than 0.5 wt %

Nickel improves the ductility of cementite and hence contributes to drawability. Nickel in an amount equal to or slightly less than that of copper effectively prevents heat cracking caused by copper. On the other hand, nickel is expensive and is not so effective in increasing strength; therefore, the upper limit of nickel content should be 0.5 wt %.

Nb and V: each less than 0.02 wt %

Nb and V improve hardenability and are effective in increasing strength. However, if added in an excess amount, they form carbides excessively, decreasing carbon to form lamellar cementite, with the result that strength decreases and the second phase ferrite excessively forms. Therefore, their respective upper limit should be 0.02 wt %.

Incidentally, Japanese Patent Laid-open No. 49592/1994 discloses a steel for high-carbon steel wire which is incorporated with chromium as well as boron. According to this technology, boron is added in proportion to the chromium content so as to promote the growth of cementite in pearlite. Therefore, the disclosed technology is entirely different from the present invention in the object and effect of incorporating boron.

The high-carbon steel wire according to the second embodiment may be produced from a Ti-containing high-carbon steel product which has the same chemical composition as the high-carbon steel wire and has TiN inclusions whose maximum diameter is smaller than 8.0 $\mu$m.

This steel product can be readily made into a high-carbon steel wire superior in resistance to longitudinal cracking by the ordinary wire producing process, because it contains free boron which inhibits the formation of ferrite, thereby making it less liable to increase in ferrite content (due to decrease in carbon content in the surface layer of the wire) even after hot-rolling, drawing, and patenting. In addition, since the maximum diameter of TiN inclusions is limited to 8.0 $\mu$m, it is less liable to breakage during drawing and is good in drawability.

The aforesaid Ti-containing high-carbon steel product can be produced easily from a steel of the same chemical composition as the high-carbon steel wire in the second embodiment by casting, cooling at a rate greater than 5° C./sec, and hot-rolling the resulting billet. The above-specified rate (greater than 5° C./sec) of cooling from casting to solidification inhibits the grain growth of TiN inclusions so that their maximum grain diameter is smaller than 8.0 $\mu$m. The cooling rate after casting should preferably be greater than 8° C./sec, more preferably greater than 10° C./sec. The billet may be heated and rolled in the usual way. Usually, the heating temperature is about 1000–1300° C., the rolling finish temperature is higher than the $Ar_3$ point, and the coiling temperature is about 100–300° C.

The high-carbon steel according to the third embodiment will be explained in the following. It is characterized in that the essential components are C (0.65–1.2wt %), Si (0.1–2.0 wt %), Mn (0.2–2.0 wt %), B (0.0003–0.0050wt %, B in solid solution more than 0.0003 wt %), N (less than 0.0050 wt %), and Fe, with the amount of Ti being limited to 0–0.005 wt %, and the main phase is pearlite and the ferrite area ratio in the surface layer up to a depth of 50 $\mu$m from the surface is smaller than 0.40%.

The high-carbon steel wire pertaining to the third embodiment is characterized in that it contains free boron as an essential component although it contains no titanium. According to the conventional technology, steel cannot practically contain free boron unless it is incorporated with a nitride-forming element such as Ti, Nb, and Al. This is because boron itself is a nitride-forming element and the technical development was focused on low- or medium-carbon steel (with less than 0.5 wt % carbon) and low alloy steel. The third embodiment is based on a new finding that steel can contain free boron if the amount of nitrogen is strictly controlled in high-carbon steel or hyper-eutectic steel and the heating temperature and the cooling rate (after rolling) are strictly controlled. Therefore, the high-carbon steel pertaining to the third embodiment is completely free from titanium inclusions detrimental to drawing, so that it can be drawn into a high-strength thin wire which has never been obtained by the conventional technology. The free boron in the steel wire produced in the third embodiment remains intact during patenting and inhibits the formation of ferrite. (Patenting for high-carbon steel wires such as tire cords is usually finished within a short time, say, one minute.) Thus the steel has good drawability and is not liable to delamination (in the twisting test). The high-carbon steel wire according to the third embodiment is industrially useful as super-high-strength steel wire.

The high-carbon steel wire in the third embodiment is limited in the chemical composition (except for Ti, B, and N), the main phase, and the amount of ferrite in the surface layer for the same reason as mentioned in the second embodiment. A detailed description is given below of the reason why the amount of free boron (or boron in solid solution) and titanium is limited.

Titanium (as an impurity) should preferably be absent, and the upper limit of titanium content should be 0.005 wt %. With a titanium content within this limit, the steel produced under the conditions mentioned later contains sufficient free boron and has good drawability.

In order to ensure the presence of free boron which inhibits the formation of ferrite, it is necessary to add boron in a total amount of at least 0.0003 wt %. On the other hand, with an amount in excess of 0.0050 wt %, boron forms $Fe_{23}(CB)_6$, thereby aggravating drawability. Therefore, the upper limit of boron content should be 0.0050 wt %, preferably 0.0040 wt %. The boron which inhibits the formation of ferrite is not the added boron but the free boron which does not form any compound in the steel. For free boron to exist, it is necessary that BN should not be formed. Consequently, the amount of nitrogen should be less than 0.0050 wt %, preferably less than 0.0035 wt %. In addition, it is also necessary to control the rolling conditions as mentioned later. Free boron should be present in an amount of at least 0.0003 wt % if it is to inhibit the formation of ferrite. The larger the amount of free boron, the more desirable. However, the upper limit of the amount of free boron is imposed naturally by the limitation of the amount of boron that can be added.

Incidentally, the high-carbon steel wire according to the third embodiment is composed of the above-mentioned basic components and essential component (iron), but it may be incorporated with any one or more of Cr, Cu, Ni, Nb, and V as material improving elements, as in the case of the high-carbon steel wire according to the second embodiment.

The high-carbon steel wire according to the third embodiment may be produced from a Ti-containing high-carbon steel product having the same chemical composition as the high-carbon steel wire according to the third embodiment by hot-rolling, drawing, patenting, and optional finish drawing.

This steel product may be obtained from a steel having the same chemical composition as the high-carbon steel wire according to the third embodiment by casting, cooling at a rate greater than 5° C./sec (from casting to solidification), and hot-rolling the resulting billet. (The amount of boron in the chemical composition denotes the amount of boron added which is 0.0003–0.0050 wt %.) The hot-rolling of the billet should be carried out at 900–1300° C., preferably at a temperature lower than 1200° C., and the finish temperature of the hot-rolling should be 900–1100° C. The rolled product should be cooled to 850° C. within 30 seconds.

Casting should be followed by cooling at a rate greater than 5° C./sec, so that titanium inclusions become fine particles which do not cause wire breakage during drawing.

During hot rolling, the billet should be heated above 900° C. Otherwise, the billet cannot be rolled due to excess load.

Thus the lower limit of the heating temperature should be 900° C. Heating above 900° C., preferably above 930° C., causes most boron in the steel to form a solid solution in which free boron exists. The amount of free boron is proportional to the heating temperature. However, an excessively high heating temperature results in coarse austenite crystal grains which reduce the reduction in area of the wire rod. Therefore, the upper limit should be 1300° C., preferably 1200° C.

What is most important for the existence of free boron is the finish temperature (the temperature at which the finish rolling ends) and the cooling that follows the hot rolling. The desirable conditions were established on the results of the experiment simulating the hot-rolling and ensuring cooling. This experiment was performed on a titanium-free hyper-eutectic steel which has the chemical composition of C (1.0 wt %) Si (0.3 wt %), Mn (0.35 wt %), B (0.0030 wt % or 30 ppm), and N (0.0037 wt %), with the remainder being Fe. In the experiment, the steel was heated at 1000° C. and then allowed to cool down to 950° C., 900° C., 850° C., and 800° C. (corresponding to the finish temperature). After cooling to the specified temperature, the sample was kept at that temperature for 3 sec, 10 sec, 30 sec, 100 sec, and 180 sec and then water-cooled. After cooling, the amount of free boron in the steel was determined in the following way. The sample was electrolytically extracted and the amount of boron remaining as a compound in the residue was determined by curcumine absorptiometry. The amount of free boron was calculated from the difference between the amount of boron as a compound and the amount of boron added. The results of the experiment are shown in FIG. 2. The numerals in the figure indicate the amount of free boron (in ppm). The curve A represents cooling from 1100° C. at a rate of 20° C./sec. The curve B represents cooling from 1000° C. at a rate of 20° C./sec. The curve C represents cooling from 900° C. at a rate of 20° C./sec.

It is noted from FIG. 2 that the amount of free boron is small if the holding temperature is lower than 850° C. It is also noted that at temperatures below 850° C., the amount of free boron decreases in proportion to the holding time. The amount of free boron decreases to 3 ppm (or 0.0003 wt %) if the temperature is 850° C. and the holding time is 30 sec. At 800° C., the amount of free boron decreases less in proportion to the holding time, with 13 ppm (0.0013 wt %) remaining after holding for 30 seconds. FIG. 2 suggests that decrease in free boron (or precipitation of BN) in the hyper-eutectic steel is represented by the curve C having the nose temperature region. This coincides with the previous knowledge.

Based on the foregoing, the process for ensuring free boron was established. According to this process, finish rolling is followed by cooling down to 850° C. within 30 seconds. At temperatures below 850° C., boron-containing solid solution in the steel remains as it is even after winding, without boron combining with nitrogen, so long as cooling is carried out in the usual way without temperature holding.

The invention will be described in more detail with reference to the following examples, which are not intended to restrict the scope thereof.

EXAMPLE 1

A steel of the chemical composition shown in Table 1 below was cast into a billet by vacuum induction melting. The billet was cooled at a rate shown in Table 1 and then forged into a rod 115 mm square. The rod was hot-rolled into a wire 5.5 mm in diameter. The wire was further drawn into a wire 2.10–1.40 mm in diameter. The drawn wire was heated to 940° C. for patenting in a fluidized bed so that conversion into austenite took place. The wire underwent isothermal transformation into fine pearlite at 540° C., pickling, brass plating, and final wet drawing. Thus there was obtained a steel wire in 0.2 mm in diameter.

Figure 1:
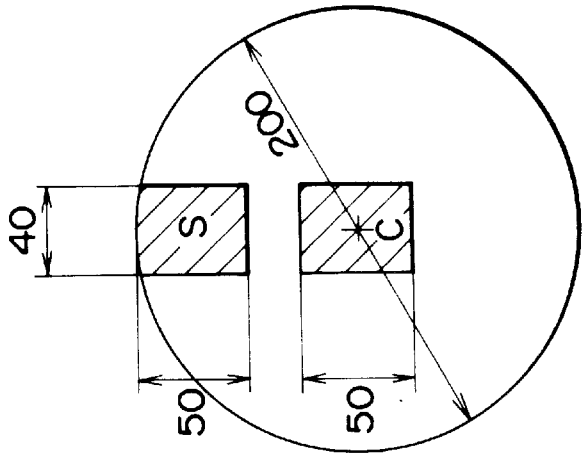
FIG. 1 is a diagram showing the region for measurements of the amount of ferrite in the high-carbon steel wire. FIG.

The steel wire was examined for the amount of ferrite in the surface layer (S) indicated in FIG. 1 by means of a SEM photograph of the structure. The steel wire was also examined for longitudinal cracking (delamination) by twisting test with a specimen 40 mm long. Twisting was repeated 30 times or until the specimen suffered longitudinal cracking. The sample was rated as good (○) if it was not broken by twisting (30 times), and the sample was rated as poor (x) if it was broken by twisting (less than 30 times). The steel wire was tested for tensile strength. The hot-rolled wire rod (0.2 kg) had its parent phase dissolved and the residue was examined for the maximum particle diameter of TiN therein. Drawability was evaluated by observing whether or not the hot-rolled wire rod (30 kg) is completely drawn into wire (0.2 mm in diameter) without breakage. The results are shown in Table 2. The sample was rated as poor (x) if it was broken once or more. In case of infrequent breakage, drawing was continued by splicing broken wires until the final diameter was achieved. In case of frequent breakage, drawing was suspended and twisting test was not conducted. ("No test" is indicated by "–" in the table.)

TABLE 1

| Steel | Chemical composition (wt %), remainder being substantially Fe | | | | | | | | Value | CR | |
|---|---|---|---|---|---|---|---|---|---|---|---|
| No. | C | Si | Mn | Ti | Cr | B | N | Others | of Q | ° C./s | Note |
| 1 | 0.90 | 0.20 | 0.70 | — | — | — | 0.0030 | | — | 10.00 | Comp. |
| 2 | 0.90 | 0.20 | 0.40 | — | — | — | 0.0030 | | — | 10.00 | Comp. |
| 3 | 0.90 | 0.20 | 0.30 | — | 1.00 | — | 0.0030 | | — | 10.00 | Comp. |
| 4 | 0.90 | 0.20 | 0.40 | 0.01 | 0.20 | 0.0020 | 0.0020 | | 2.1847 | 10.00 | |
| 5 | 0.90 | 0.20 | 0.40 | 0.01 | 0.20 | 0.0020 | 0.0040 | | −1.344 | 10.00 | Comp. |
| 6 | 0.90 | 0.20 | 0.40 | 0.01 | 0.20 | 0.0020 | 0.0060 | | −0.648 | 10.00 | Comp. |
| 7 | 0.90 | 0.90 | 0.40 | 0.01 | 0.20 | 0.0020 | 0.0020 | | 2.1847 | 10.00 | |
| 8 | 0.90 | 2.50 | 0.40 | 0.01 | 0.20 | 0.0020 | 0.0020 | | 2.1847 | 10.00 | Comp. |
| 9 | 0.90 | 0.20 | 1.50 | 0.01 | — | 0.0020 | 0.0020 | | 2.1847 | 10.00 | |
| 10 | 0.90 | 0.20 | 2.50 | 0.01 | 0.20 | 0.0020 | 0.0020 | | 2.1847 | 10.00 | Comp. |
| 11 | 0.90 | 0.20 | 0.40 | 0.02 | 0.20 | 0.0020 | 0.0020 | | 0.5221 | 10.00 | |
| 12 | 0.90 | 0.20 | 0.40 | 0.04 | 0.20 | 0.0020 | 0.0020 | | 0.2070 | 10.00 | Comp. |
| 13 | 0.90 | 0.20 | 0.40 | 0.01 | 0.20 | 0.0020 | 0.0020 | Cu: 0.1 | 2.1847 | 10.00 | |
| 14 | 0.90 | 0.20 | 0.40 | 0.01 | 0.20 | 0.0020 | 0.0020 | Ni: 0.1<br>Cu: 0.1 | 2.1847 | 10.00 | |
| 15 | 0.90 | 0.20 | 0.40 | 0.01 | 0.20 | 0.0020 | 0.0020 | Nb: 0.01 | 2.1847 | 10.00 | |
| 16 | 0.90 | 0.20 | 0.40 | 0.01 | 0.20 | 0.0020 | 0.0020 | Nb: 0.03 | 2.1847 | 10.00 | Comp. |

TABLE 1-continued

| Steel No. | Chemical composition (wt %), remainder being substantially Fe C | Si | Mn | Ti | Cr | B | N | Others | Value of Q | CR ° C./s | Note |
|---|---|---|---|---|---|---|---|---|---|---|---|
| 17 | 0.90 | 0.20 | 0.40 | 0.01 | 0.20 | 0.0020 | 0.0020 | V: 0.01 | 2.1847 | 10.00 | |
| 18 | 0.90 | 0.20 | 0.40 | 0.01 | 0.20 | 0.0020 | 0.0020 | V: 0.03 | 2.1847 | 10.00 | Comp. |
| 19 | 0.90 | 0.20 | 0.40 | 0.01 | 0.20 | 0.0010 | 0.0020 | | 1.0924 | 10.00 | |
| 20 | 0.90 | 0.20 | 0.40 | 0.01 | 0.20 | — | 0.0020 | | — | 10.00 | Comp. |
| 21 | 0.90 | 0.20 | 0.40 | 0.01 | 0.20 | 0.0040 | 0.0020 | | 4.3694 | 10.00 | |
| 22 | 0.90 | 0.20 | 0.40 | 0.01 | 0.20 | 0.0020 | 0.0040 | | −1.844 | 10.00 | Comp. |
| 23 | 0.97 | 0.20 | 0.40 | 0.01 | 0.20 | 0.0020 | 0.0020 | | 2.1847 | 10.00 | |
| 24 | 1.10 | 0.20 | 0.40 | 0.01 | 0.20 | 0.0020 | 0.0020 | | 2.1847 | 10.00 | |
| 25 | 1.30 | 0.20 | 0.40 | 0.01 | 0.20 | 0.0020 | 0.0020 | | 2.1847 | 10.00 | Comp. |
| 26 | 0.82 | 0.20 | 0.40 | 0.01 | 0.20 | 0.0020 | 0.0020 | | 2.1847 | 10.00 | |
| 27 | 0.72 | 0.20 | 0.40 | 0.01 | 0.20 | 0.0020 | 0.0020 | | 2.1847 | 10.00 | |
| 28 | 0.62 | 0.20 | 0.40 | 0.01 | 0.20 | 0.0020 | 0.0020 | | 2.1847 | 10.00 | |
| 29 | 0.52 | 0.20 | 0.40 | 0.01 | 0.20 | 0.0020 | 0.0020 | | 2.1847 | 10.00 | Comp. |
| 30 | 0.90 | 0.20 | 0.40 | 0.01 | 0.20 | 0.0020 | 0.0020 | | 2.1847 | 80.00 | |
| 31 | 0.90 | 0.20 | 0.40 | 0.01 | 0.20 | 0.0020 | 0.0020 | | 2.1847 | 0.50 | Comp. |
| 32 | 0.90 | 0.20 | 0.40 | 0.01 | — | 0.0020 | 0.0020 | | 2.1847 | 10.00 | |
| 33 | 0.97 | 0.20 | 0.40 | 0.01 | — | 0.0020 | 0.0020 | Cu: 0.1 | 2.1847 | 10.00 | |
| 34 | 0.97 | 0.20 | 0.40 | 0.01 | — | 0.0020 | 0.0020 | Cu: 0.8 | 2.1847 | 10.00 | Comp. |
| 35 | 0.97 | 0.20 | 0.40 | 0.01 | — | 0.0020 | 0.0020 | Ni: 0.1<br>Cu: 01 | 2.1847 | 10.00 | |
| 36 | 0.97 | 0.20 | 0.40 | 0.01 | — | 0.0020 | 0.0020 | Ni: 0.3<br>Cu: 0.7 | 2.1847 | 10.00 | Comp. |

CR : cooling rate after casting;
Q = B/(Ti/3.43−N);
Comp. : Comparative Example

TABLE 2

| Sample No. | Steel No. | Amount of ferrite vol % | TiN particles (μm), max | Final drawing Initial diameter (mm) | True strain | Steel wire TS MPa | Breakage | Longitudinal cracking | Note |
|---|---|---|---|---|---|---|---|---|---|
| 1 | 1 | 0.43 | — | 1.40 | 3.89 | 3950 | ○ | x | Comp. |
| 2 | 2 | 0.42 | — | 1.40 | 3.89 | 3970 | ○ | ○ | Comp. |
| 3 | 3 | 0.72 | — | 1.40 | 3.89 | 4210 | ○ | x | Comp. |
| 4 | 4 | 0.15 | 1.91 | 1.40 | 3.89 | 4020 | ○ | ○ | Comp. |
| 5 | 5 | 0.31 | 2.43 | 1.40 | 3.89 | 3960 | ○ | ○ | |
| 6 | 6 | 0.32 | 3.90 | 1.40 | 3.89 | 3988 | ○ | x | Comp. |
| 7 | 7 | 0.19 | 1.93 | 1.40 | 3.89 | 4010 | ○ | ○ | |
| 8 | 8 | 0.56 | 1.90 | 1.40 | 3.89 | 4020 | ○ | x | Comp. |
| 9 | 9 | 0.20 | 1.97 | 1.40 | 3.89 | 4030 | ○ | ○ | |
| 10 | 10 | 0.63 | 1.94 | 1.40 | 3.89 | 4016 | ○ | x | Comp. |
| 11 | 11 | 0.14 | 2.60 | 1.40 | 3.89 | 4025 | ○ | ○ | |
| 12 | 12 | 0.19 | 12.80 | 1.40 | 3.89 | 4016 | x | ○ | Comp. |
| 13 | 13 | 0.21 | 2.10 | 1.40 | 3.89 | 4024 | ○ | ○ | |
| 14 | 14 | 0.22 | 2.80 | 1.40 | 3.89 | 4057 | ○ | ○ | |
| 15 | 15 | 0.29 | 1.60 | 1.40 | 3.89 | 4120 | ○ | ○ | |
| 16 | 16 | 0.59 | 1.60 | 1.40 | 3.89 | 4180 | ○ | x | Comp. |
| 17 | 17 | 0.28 | 1.35 | 1.40 | 3.89 | 4160 | ○ | ○ | |
| 18 | 18 | 0.55 | 1.28 | 1.40 | 3.89 | 4230 | ○ | x | Comp. |
| 19 | 19 | 0.22 | 1.01 | 1.40 | 3.89 | 4075 | ○ | ○ | |
| 20 | 20 | 0.45 | 1.24 | 1.40 | 3.89 | 4035 | ○ | x | Comp. |
| 21 | 21 | 0.19 | 1.43 | 1.40 | 3.89 | 4078 | ○ | ○ | |
| 22 | 22 | 0.53 | 8.60 | 1.40 | 3.89 | 4035 | x | x | Comp. |
| 23 | 23 | 0.21 | 1.34 | 1.40 | 3.89 | 4120 | ○ | ○ | |
| 24 | 24 | 0.22 | 1.94 | 1.40 | 3.89 | 4250 | ○ | ○ | |
| 25 | 25 | 0.21 | 1.70 | 1.40 | 2.77 | — | x | — | Comp. |
| 26 | 26 | 0.19 | 1.57 | 1.50 | 4.03 | 4012 | ○ | ○ | |
| 27 | 27 | 0.21 | 1.67 | 1.70 | 4.28 | 4011 | ○ | ○ | |
| 28 | 28 | 0.38 | 1.80 | 1.90 | 4.50 | 4007 | ○ | ○ | |
| 29 | 29 | 1.50 | 1.60 | 2.10 | 4.70 | 3820 | x | x | Comp. |
| 30 | 30 | 0.14 | 0.48 | 1.40 | 3.89 | 4022 | ○ | ○ | |
| 31 | 31 | 0.16 | 10.50 | 1.40 | 3.89 | 4015 | x | ○ | Comp. |
| 32 | 32 | 0.15 | 1.91 | 1.40 | 3.89 | 3930 | ○ | ○ | |
| 33 | 33 | 0.22 | 2.20 | 1.40 | 3.89 | 4086 | ○ | ○ | |
| 34 | 34 | 0.23 | 2.40 | 1.40 | 3.89 | 4138 | ○ | x | Comp. |
| 35 | 35 | 0.21 | 2.60 | 1.40 | 3.89 | 4098 | ○ | ○ | |
| 36 | 36 | 0.20 | 2.50 | 1.40 | 3.89 | 4129 | ○ | x | Comp. |

Comp.: Comparative Example

It is noted from Table 2 that those samples which have the composition as specified in the present invention and which are cooled at a rate greater than 5° C./sec after casting have a ferrite area ratio lower than 0.40% (in the surface layer up to a depth of 50 μm from the surface), strength greater than 4000 MPa, good drawability, and good resistance to longitudinal cracking.

EXAMPLE 2

A steel of the chemical composition shown in Table 3 below was cast into a billet by vacuum induction melting. The billet was cooled at a rate shown in Table 3. The billet was heated to 1150° C. and then hot-rolled such that the finish temperature was 1000° C. The hot-rolling was followed by air cooling for 12 sec from 1000° C. to 850° C. (at a cooling rate of 12.5° C./sec) Thus there was obtained a wire rod 5.5 mm in diameter. This wire rod was drawn into a wire 2.0–1.5 mm in diameter. This wire sequentially underwent patenting in a fluidized bed, pickling, brass plating, and final wet drawing. Thus there was obtained a steel wire having the final diameter shown in Table 4. (In the case of breakage during drawing, the diameter of the steel wire obtained before breakage is given.) Incidentally, the wire rod resulting from hot rolling was examined for the content of free boron in solid solution by the procedure mentioned above. The results are shown in Table 3.

The steel No. 27 in Table 3 was processed into three kinds of wire rods (each 5.5 mm in diameter) by hot rolling under the following conditions. Hot-rolling was followed by cooling, with the cooling time adjusted by the amount of blasting air. Each wire rod was examined for the amount of free boron in solid solution. The wire rods were drawn into steel wires which are designated as Samples Nos. 34 to 36 in Table 4.

Conditions of hot rolling:

Sample No. 34

SRT: 1100° C., FDT: 1000° C., T850: 40 sec, B: 0.0002%

Sample No. 35

SRT: 1030° C., FDT: 1000° C., T850: 18 sec, B: 0.0020%

Sample No. 36

SRT: 1000° C., FDT: 850° C., T850: 0 sec, B: 0.000%

(SRT stands for heating temperature, FDT stands for finish temperature, and T850 stands for time required for cooling to 850° C.)

The steel wire was examined for the amount of boron in solid solution by the procedure mentioned above and also for the amount of ferrite in the surface layer (S) indicated in FIG. 1 by means of a SEM photograph of the structure. The steel wire was also examined for longitudinal cracking (delamination) by twisting test with a specimen 40 mm long. Twisting was repeated 30 times or until the specimen suffered longitudinal cracking. The sample was rated as good (○) if it was not broken by twisting (30 times), and the sample was rated as poor (x) if it was broken by twisting (less than 30 times). The steel wire was tested for tensile strength. Drawability was evaluated by observing whether or not the hot-rolled wire rod (30 kg) is completely drawn into wire (0.2 mm in diameter) without breakage. The results are shown in Table 4. The sample was rated as poor (x) if it was broken once or more. In case of infrequent breakage, drawing was continued by splicing broken wires until the final diameter was achieved. In case of frequent breakage, drawing was suspended and twisting test was not conducted. ("No test" is indicated by "–" in the table.) Incidentally, the mark "–" indicates "not measured" in the column of free boron in Table 3 and the columns of TS and free boron in Table 4.

TABLE 3

| Steel | Chemical composition (wt %), with remainder being substantially Fe | | | | | | | | Boron | CR | |
|---|---|---|---|---|---|---|---|---|---|---|---|
| No. | C | Si | Mn | B | N | Ti | Cr | Others | (wt %) | ° C./s | Note |
| 1 | 0.90 | 0.20 | 0.70 | — | 0.0030 | — | — | | — | 5 | Comp. |
| 2 | 0.90 | 0.20 | 0.40 | — | 0.0030 | — | 0.20 | | — | 5 | Comp. |
| 3 | 0.90 | 0.20 | 0.30 | — | 0.0030 | — | 1.00 | | — | 5 | Comp. |
| 4 | 0.62 | 0.20 | 0.40 | 0.0023 | 0.0040 | — | — | | 0.0017 | 5 | Comp. |
| 5 | 1.21 | 0.19 | 0.35 | 0.0020 | 0.0030 | — | — | | 0.0015 | 5 | Comp. |
| 6 | 0.92 | 0.08 | 0.40 | 0.0030 | 0.0048 | — | 0.21 | | 0.0022 | 5 | Comp. |
| 7 | 0.92 | 2.02 | 0.40 | 0.0025 | 0.0030 | — | 0.21 | | 0.0020 | 5 | Comp. |
| 8 | 0.90 | 0.20 | 0.18 | 0.0028 | 0.0048 | — | 0.30 | | 0.0020 | 5 | Comp. |
| 9 | 0.90 | 0.20 | 2.02 | 0.0020 | 0.0039 | — | — | | 0.0015 | 5 | Comp. |
| 10 | 0.90 | 0.20 | 0.43 | 0.0001 | 0.0040 | — | 0.20 | | — | 5 | Comp. |
| 11 | 0.90 | 0.20 | 0.43 | 0.0052 | 0.0040 | — | 0.20 | | 0.0045 | 5 | Comp. |
| 12 | 0.90 | 0.20 | 0.40 | 0.0020 | 0.0050 | 0.006 | 0.20 | | 0.0010 | 5 | Comp. |
| 13 | 0.90 | 0.19 | 0.35 | 0.0020 | 0.0050 | 0.004 | — | | 0.0010 | 3 | Comp. |
| 14 | 0.90 | 0.20 | 0.40 | 0.0020 | 0.0060 | — | 0.20 | | 0.0009 | 3 | Comp. |
| 15 | 0.90 | 0.20 | 0.40 | 0.0020 | 0.0040 | — | 0.20 | Nb: 0.03 | 0.0010 | 3 | Comp. |
| 16 | 0.90 | 0.20 | 0.40 | 0.0020 | 0.0040 | — | 0.20 | V: 0.03 | 0.0011 | 3 | Comp. |
| 17 | 0.91 | 0.22 | 0.41 | 0.0020 | 0.0040 | — | — | Ni: 0.6 | 0.0011 | 3 | Comp. |
| 18 | 0.90 | 0.20 | 0.40 | 0.0025 | 0.0040 | — | — | Cu: 0.6 | 0.0015 | 3 | Comp. |
| 19 | 0.65 | 0.21 | 0.45 | 0.0022 | 0.0045 | — | — | | 0.0015 | 5 | |
| 20 | 1.20 | 0.18 | 0.29 | 0.0018 | 0.0045 | — | — | | 0.0007 | 5 | |
| 21 | 0.92 | 0.10 | 0.35 | 0.0021 | 0.0040 | — | 0.19 | | 0.0010 | 5 | |
| 22 | 0.92 | 2.00 | 0.38 | 0.0023 | 0.0043 | — | 0.20 | | 0.0013 | 5 | |
| 23 | 0.91 | 0.18 | 0.20 | 0.0031 | 0.0050 | — | 0.22 | | 0.0025 | 5 | |
| 24 | 0.91 | 0.18 | 2.00 | 0.0026 | 0.0040 | — | — | | 0.0016 | 5 | |
| 25 | 0.90 | 0.20 | 0.45 | 0.0004 | 0.0045 | — | 0.21 | | 0.0003 | 5 | |
| 26 | 0.90 | 0.20 | 0.45 | 0.0050 | 0.0045 | — | 0.21 | | 0.0034 | 5 | |
| 27 | 0.95 | 0.18 | 0.38 | 0.0025 | 0.0038 | 0.005 | — | | 0.0014 | 5 | |
| 28 | 0.89 | 0.19 | 0.42 | 0.0020 | 0.0050 | — | — | | 0.0010 | 5 | |
| 29 | 1.10 | 0.18 | 0.43 | 0.0048 | 0.0035 | — | 0.21 | | 0.0023 | 5 | |
| 30 | 0.93 | 0.25 | 0.38 | 0.0025 | 0.0040 | — | — | Ni: 0.5 | 0.0014 | 5 | |

TABLE 3-continued

| Steel | Chemical composition (wt %), with remainder being substantially Fe | | | | | | | | Boron | CR | |
|---|---|---|---|---|---|---|---|---|---|---|---|
| No. | C | Si | Mn | B | N | Ti | Cr | Others | (wt %) | ° C./s | Note |
| 31 | 0.91 | 0.18 | 0.40 | 0.0039 | 0.0039 | — | — | Nb: 0.03 | 0.0012 | 5 | |
| 32 | 0.90 | 0.20 | 0.38 | 0.0034 | 0.0040 | — | — | V: 0.03 | 0.0011 | 5 | |
| 33 | 0.91 | 0.23 | 0.38 | 0.0030 | 0.0039 | — | — | Cu: 0.5 | 0.0013 | 5 | |

CR: Cooling rate (° C./s) after casting;
Comp.: Comparative Example

TABLE 4

| Sample No. | Steel No. | Final drawing Diameter (mm) | True strain | TS (MPa) | Boron (wt %) | Ferrite (vol %) | Breakage | Cracking | Note |
|---|---|---|---|---|---|---|---|---|---|
| 1 | 1 | 0.20 | 34.89 | 3950 | — | 0.43 | ○ | x | Comp. |
| 2 | 2 | 0.20 | 3.89 | 3970 | — | 0.42 | ○ | ○ | Comp. |
| 3 | 3 | 0.20 | 3.89 | 4210 | — | 0.72 | ○ | x | Comp. |
| 4 | 4 | 0.20 | 4.07 | 3672 | 0.0017 | 12.10 | ○ | ○ | Comp. |
| 5 | 5 | 0.44 | 2.49 | — | 0.0015 | 0.24 | x | — | Comp. |
| 6 | 6 | 0.20 | 4.07 | 3900 | 0.0022 | 0.33 | ○ | ○ | Comp. |
| 7 | 7 | 0.20 | 3.82 | — | 0.0020 | 0.22 | x | — | Comp. |
| 8 | 8 | 0.20 | 4.07 | 3922 | 0.0020 | 0.34 | ○ | ○ | Comp. |
| 9 | 9 | 0.25 | 3.62 | — | 0.0015 | 0.33 | ○ | x | Comp. |
| 10 | 10 | 0.20 | 4.07 | 4112 | — | 0.60 | ○ | x | Comp. |
| 11 | 11 | 0.25 | 3.62 | — | 0.0045 | 0.10 | x | — | Comp. |
| 12 | 12 | 0.25 | 3.62 | — | 0.0010 | 0.15 | x | — | Comp. |
| 13 | 13 | 0.20 | 4.07 | 4112 | 0.0001 | 0.72 | x | x | Comp. |
| 14 | 14 | 0.20 | 4.07 | 4241 | 0.0002 | 0.49 | ○ | x | Comp. |
| 15 | 15 | 0.20 | 3.89 | 4159 | 0.0010 | 0.25 | ○ | x | Comp. |
| 16 | 16 | 0.20 | 4.06 | 4101 | 0.0011 | 0.34 | ○ | x | Comp. |
| 17 | 17 | 0.20 | 4.07 | 4131 | 0.0011 | 0.29 | ○ | x | Comp. |
| 18 | 18 | 0.20 | 4.07 | 4112 | 0.0015 | 0.35 | ○ | x | Comp. |
| 19 | 19 | 0.17 | 4.51 | 4078 | 0.0015 | 0.13 | ○ | ○ | |
| 20 | 20 | 0.20 | 3.82 | 4502 | 0.0007 | 0.24 | ○ | ○ | |
| 21 | 21 | 0.18 | 4.37 | 4427 | 0.0010 | 0.26 | ○ | ○ | |
| 22 | 22 | 0.18 | 4.37 | 4627 | 0.0013 | 0.30 | ○ | ○ | |
| 23 | 23 | 0.20 | 4.16 | 4211 | 0.0025 | 0.24 | ○ | ○ | |
| 24 | 24 | 0.20 | 4.07 | 4231 | 0.0016 | 0.15 | ○ | ○ | |
| 25 | 25 | 0.17 | 4.35 | 4373 | 0.0003 | 0.20 | ○ | ○ | |
| 26 | 26 | 0.17 | 4.39 | 4411 | 0.0034 | 0.10 | ○ | ○ | |
| 27 | 27 | 0.20 | 4.16 | 4289 | 0.0014 | 0.24 | ○ | ○ | |
| 28 | 28 | 0.20 | 4.16 | 4173 | 0.0010 | 0.24 | ○ | ○ | |
| 29 | 29 | 0.20 | 4.07 | 4520 | 0.0023 | 0.29 | ○ | ○ | |
| 30 | 30 | 0.19 | 4.38 | 4460 | 0.0014 | 0.31 | ○ | ○ | |
| 31 | 31 | 0.20 | 4.03 | 4146 | 0.0012 | 0.27 | ○ | ○ | |
| 32 | 32 | 0.20 | 4.07 | 4162 | 0.0011 | 0.22 | ○ | ○ | |
| 33 | 33 | 0.20 | 4.07 | 4131 | 0.0031 | 0.36 | ○ | ○ | |
| 34 | 27 | 0.20 | 4.07 | 4520 | 0.0002 | 0.56 | ○ | x | Comp. |
| 35 | 27 | 0.20 | 4.07 | 4520 | 0.0013 | 0.27 | ○ | ○ | |
| 36 | 27 | 0.20 | 4.07 | 4520 | 0.0000 | 0.68 | ○ | x | Comp. |

Comp.: Comparative example,
TS: Tensile strength of steel wire,
Boron: Free boron in solid solution in steel wire,
Ferrite: Amount of ferrite in the surface layer of steel wire,
Breakage: Breakage of steel wire,
Cracking: Longitudinal cracking.

It is noted from Table 4 that Samples Nos. 1 to 18, which were prepared from the steel for comparison, were mostly poor in tensile strength (less than 4000 MPa) and liable to breakage during drawing. Even though some of them were drawn to the final diameter, they suffered longitudinal cracking in the twisting test. It is also noted that Samples Nos. 19 to 32, which were prepared from the steel according to the present invention, are capable of drawing satisfactorily even at a true strain greater than 4.0 and exhibit a high tensile strength (in excess of 4000 MPa) without delamination. These good properties are due to the sufficient amount of free boron in solid solution which keeps low the amount of ferrite in the surface layer of the steel wire. (Ferrite causes longitudinal cracking to start from it.) Samples Nos. 34 and 36 suffered delamination even though they were prepared from the steel No. 27 according to the present invention. Delamination in Sample No. 34 is due to inadequate cooling despite adequate finish temperature. (Time required for cooling to 850° C. was longer than that specified in the invention.) Delamination in Sample No. 36 is due to insufficient amount of free boron. (Finish temperature was lower than that specified in the invention.)

(Effect of the invention) The high-carbon steel wire of the present invention is produced such that the ferrite area ratio is smaller than 0.40% in the surface layer up to a depth of 50 μm from the surface. This implies that the amount of ferrite, which is responsible for longitudinal cracking, is kept low sufficiently. Therefore, the steel wire has a high strength and yet is superior in resistance to longitudinal cracking. The steel product according to the present invention can be readily made into a high-carbon steel wire having a high strength and good resistance to longitudinal cracking by reduction in area and patenting in the usual way. The process of the present invention permits easy production of the steel product for the above-mentioned steel wire.

What is claimed is:

1. A high-carbon steel wire comprising C (0.65–1.2 wt %), Si (0.1–2.0 wt %), Mn (0.2–2.0 wt %), B (0.0003–0.0050 wt %, B in solid solution accounting for more than 0.0003 wt %), Ti (less than 0.030 wt %), N (less than 0.0050 wt %), and Fe, wherein the amounts of B, Ti, and N satisfy the equation (1), $$0.03 \leqq B/(Ti/3.43-N) \leqq 5.0 \quad (1)$$

the main phase is pearlite, and the pro-eutectoid ferrite area ratio is less than 0.40% in the surface layer up to a depth of 50,$\mu$m from the surface.

2. A high-carbon steel wire rod which has the same chemical composition as defined in claim 1 and which is characterized in that the maximum particle diameter of TiN inclusion is smaller than 8.0 $\mu$m.

3. A process for producing a high-carbon steel wire rod, said process comprising casting a steel having the same chemical composition as defined in claim 1, cooling the cast at a rate greater than 5 ° C./sec in the period from the start of casting to the completion of solidification, and hot-rolling the resulting billet.

4. A high-carbon steel wire comprising C (0.65–1.2 wt %), Si (0.1–2.0 wt %), Mn (0.2–2.0 wt %), B (0.0003–0.0050 wt %, B in solid solution accounting for more than 0.0003 wt %), N (less than 0.0050 wt %), and Fe, wherein in the wire the content of Ti is limited to 0–0.005 wt %, the main phase is pearlite, and the pro-eutectoid ferrite area ratio is less than 0.40% in the surface layer up to a depth of 50 $\mu$m from the surface.

5. A high-carbon steel wire rod comprising C (0.65–1.2 wt %), Si (0.1–2.0 wt %), Mn (0.2–2.0 wt %), B (0.0003–0.0050 wt %, B in solid solution accounting for more than 0.0003 wt %), N (less than 0.0050 wt %), and Fe, wherein in the wire rod the content of Ti is limited to 0–0.005 wt %.

6. A process for producing a wire rod for a high-carbon steel wire, said process comprising casting a steel whose essential components are C (0.65–1.2 wt %), Si (0.1–2.0 wt %), Mn (0.2–2.0 wt %), B (0.0003–0.0050 wt %), N (less than 0.0050 wt %), and Fe, where the content of Ti is limited to 0–0.005 wt % and the wire is not incorporated with Cr;

cooling the cast at a rate greater than 5° C./sec in the period from the start of casting to the completion of solidification, thereby forming a billet;

heating the resulting billet and hot-rolling it such that the finishing temperature is 900–1100° C.; and cooling the hot-rolled product to 850° C. within 30 seconds to form the wire rod, wherein in the wire rod B in solid solution accounts for more than 0.0003 wt % of the B.

7. A method for producing a high-carbon steel wire, the method comprising drawing a wire rod, and producing the wire of claim 1.

8. A method for producing a high-carbon steel wire, the method comprising drawing a wire rod, and producing the wire of claim 4.

* * * * *